United States Patent [19]

Saito et al.

[11] Patent Number: 4,890,085

[45] Date of Patent: Dec. 26, 1989

[54] TERMINAL FITTED BOBBIN

[75] Inventors: Kiyokazu Saito; Hiraku Imaizumi, both of Chiba, Japan

[73] Assignee: TDK Electronic Co., Ltd., Japan

[21] Appl. No.: 259,308

[22] Filed: Oct. 18, 1988

[30] Foreign Application Priority Data

Oct. 21, 1987 [JP] Japan ..... 62-160021[U]
May 6, 1988 [JP] Japan ..... 63-60001[U]

[51] Int. Cl.[4] ..... H01F 15/10

[52] U.S. Cl. ..... 336/192; 336/83; 336/198

[58] Field of Search ..... 336/192, 198, 208, 83; 310/71, 194

[56] References Cited

U.S. PATENT DOCUMENTS

| | | | |
|---|---|---|---|
| 2,653,992 | 9/1953 | Hill | 336/192 X |
| 3,634,878 | 1/1972 | Davis | 336/192 |
| 3,663,914 | 5/1972 | Lane | 336/192 |
| 4,166,265 | 8/1979 | Reynolds et al. | 336/192 |
| 4,318,069 | 3/1982 | Morse | 336/192 |
| 4,462,016 | 7/1984 | Bland | 336/192 |
| 4,520,288 | 5/1985 | Santi | 336/192 X |
| 4,527,141 | 7/1985 | Post | 336/192 |

FOREIGN PATENT DOCUMENTS

| | | | |
|---|---|---|---|
| 2226034 | 12/1973 | Fed. Rep. of Germany | 336/192 |
| 2224176 | 3/1980 | Fed. Rep. of Germany | 336/192 |
| 1439993 | 4/1966 | France | 336/192 |
| 1077898 | 8/1967 | United Kingdom | 336/192 |
| 1154989 | 6/1969 | United Kingdom | 336/192 |

*Primary Examiner*—Thomas J. Kozma
*Attorney, Agent, or Firm*—Leydig, Voit & Mayer

[57] ABSTRACT

A terminal fitted bobbin adapted to be fitted in a pot core so as to form a transformer or inductance element has a structure in which at least one frame provided with a plurality of terminals is formed on a flange and has at least one projection for guiding lead wires. When windings are applied to the bobbin and the bobbin is further fitted in the core, the projection guides the lead wires to be connected to terminals at the ends of the windings so they do not contact the core and is effective in automating the winding operation.

11 Claims, 8 Drawing Sheets

TERMINAL FITTED BOBBIN

BACKGROUND OF THE INVENTION

1. Field of the Invention

This invention relates to a terminal fitted bobbin for a transformer or inductance element to be fitted in a pot core.

2. Description of the Prior Art

A conventional terminal fitted bobbin to be fitted in a pot core is shown in FIGS. 1 and 2. In these drawings, an upper flange 2 and a lower flange 3 are formed respectively at both ends of a cylindrical bobbin body 1 and frames 4 are formed respectively on the right and left of the lower flange 3. Three terminals 5 are provided on each of the right and left frames 4. Here, the upper surface of frame 4 has a single step to a surface 6 that is lower than the inner surface of the lower flange 3. A guide groove 7 connected to each difference surface 6 is formed on the inner surface of the lower flange 3.

When applying windings to the conventional terminal fitted bobbin shown in FIG. 1 and 2, the lead wire, namely, the extremity of the windings can be connected directly to the central terminal 5. However the lead wires have had to be pulled out of the guide groove 7 manually, as shown by solid lines P, properly bent, hung on the endward terminals 5 and connected by soldering. Otherwise, as shown by a dotted line Q in FIG. 1, the lead wires will be connected directly to the endward terminals 5 and will disadvantageously contact the aperture edge of a pot core 8 into which the terminal fitted bobbin is placed. In order to avoid this disadvantage, it is necessary to treat the lead wires as shown by the solid line P carefully and manually. It has been impossible to automate the winding process.

SUMMARY OF THE INVENTION

A first object of the present invention is to provide a terminal fitted bobbin whereby lead wires at the ends of windings to be connected to terminals can be positively guided so as not to contact a core when the bobbin is fitted in the core.

Another object of the present invention is to provide a terminal fitted bobbin with which the process of attaching lead wires at the ends of windings can be automated.

According to the present invention, there is provided a terminal fitted bobbin wherein flanges are formed respectively at both ends of a cylindrical bobbin body part and a frame provided with a plurality of terminals is formed on at least one flange and has at least one projection for guiding lead wires on its base

BRIEF DESCRIPTION OF THE DRAWINGS

The above described objects and the other objects of the present invention will be made apparent by the following descriptions and appended drawings. Embodiments of the present invention are exemplified in these descriptions and drawings but it is apparent that various modification can be made within the scope of the claims.

DETAILED DESCRIPTION OF PREFERRED EMBODIMENT

Figure 1:
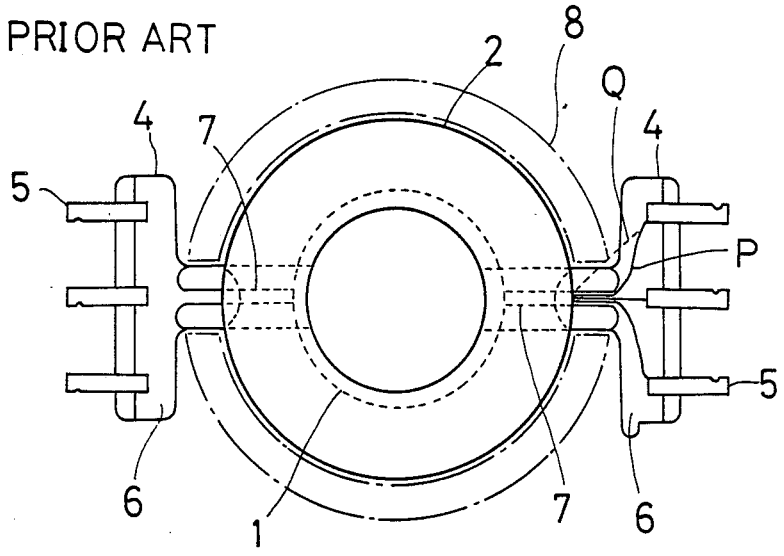
FIG. 1 PRIOR ART
FIG. 1 is a plan view of a conventional terminal fitted bobbin.
Figure 2:
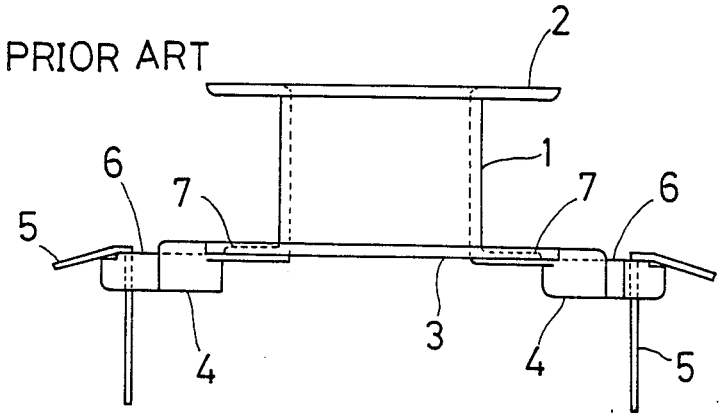
FIG. 2 PRIOR ART
FIG. 2 is an elevational view of the bobbin of FIG. 1.
Figure 3:
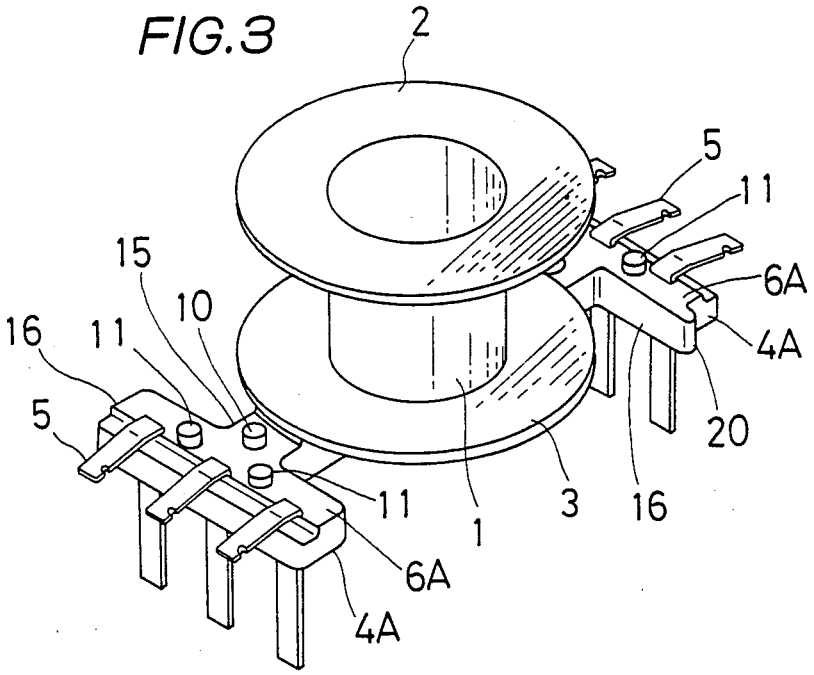
FIG. 3 is a perspective view showing a first embodiment of a terminal fitted bobbin according to the present invention.

FIGS. 3 to 7 show a first embodiment of the present invention. In this embodiment, frames 4A each include a base part 15 having a narrow width corresponding to the width dimension of an aperture of a pot core (See the reference numeral 8 in FIG. 1) into which the bobbin is to be fitted and a wide part 16 which are disposed respectively on opposite sides of a lower flange 3. Three terminals 5 are provided on each of the wide parts 16 of frames 4A and are to be positioned outside the pot core. These terminals 5 are made by bending narrow metal plates. Here, the frame 4A has a step difference surface 6A lower than the inner surface of the lower flange 3. A columnar projection 10 for guiding lead wires (i.e. extremities of the windings) is formed on the step difference surface 6A in a central position of the narrowed base part 15. Two columnar projections 11 for guiding lead wires are also formed on the step difference surface 6A in the intermediate position between the respective terminals 5 disposed on the wide part 16. The heights of the columnar projections 10 and 11 are set coincide with or to be lower than the level of the inner surface 17 of the lower flange 3.

The upper flange 2 is integrally formed at the upper end of the cylindrical bobbin body part 1 and the lower flange 3 is integrally formed at the lower end. The right and left frames 4A are integrally formed on the lower flange.

The bobbin material is a glass embedded nylon resin or the like. The substantially L-like terminal 5 may be molded integrally with the bobbin or may be inserted after molding. A projection 20 for identifying the first terminal is formed at the end of the right side frame 4A.

Figure 4:
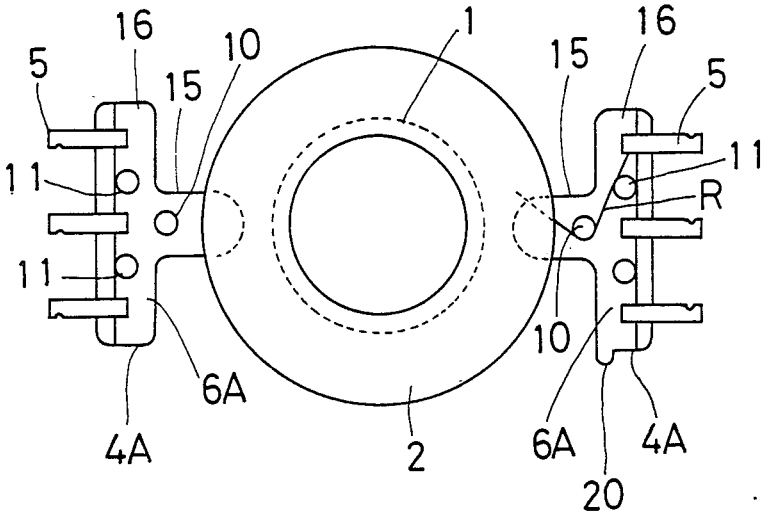
FIG. 4 is a plan view of the bobbin of FIG. 3.
Figure 5:
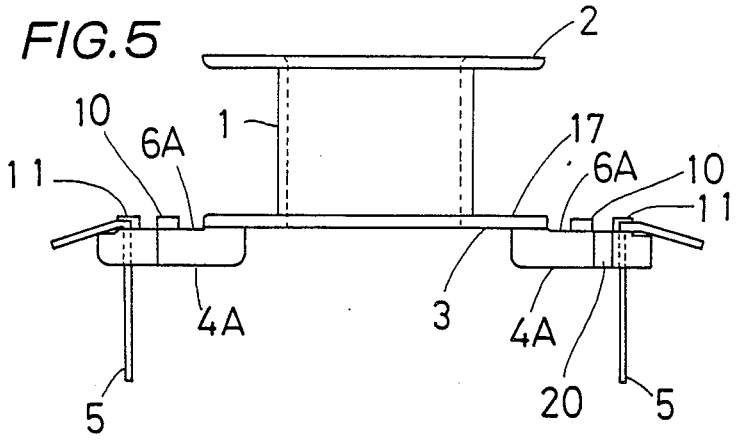
FIG. 5 is an elevational view of the bobbin of FIG. 3.
Figure 6:
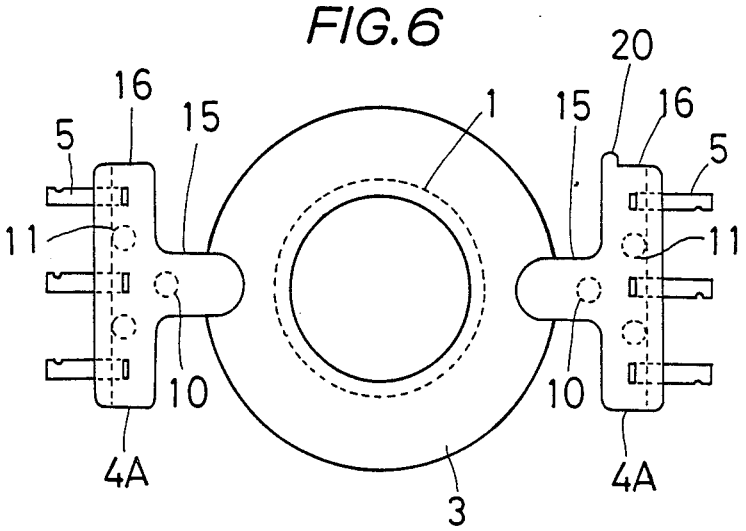
FIG. 6 is a bottom view of the bobbin of FIG. 3.
Figure 7:
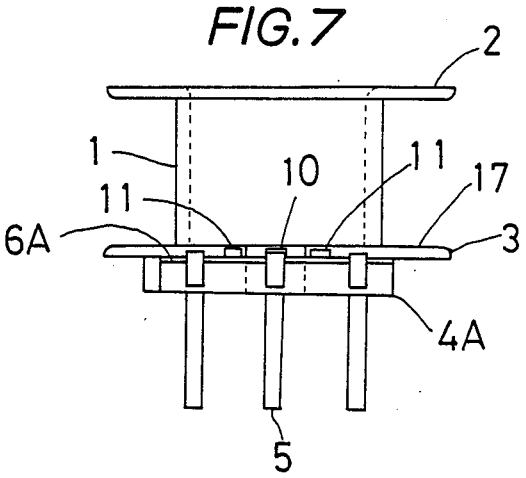
FIG. 7 is a side view of the bobbin of FIG. 3.

In the formation of the above mentioned first embodiment, in order to connect a lead wire with an endward terminal 5 in applying a winding, the lead wire may be bent along the columnar projection 10 and led out as shown by the solid line R in FIG. 4. Therefore, lead wire processing, including the operation of hanging the lead wire on the terminal, becomes manually easier. Moreover, automated wire winding on the bobbin body by an automatic winder and hanging the lead wire on the terminal becomes possible. If the lead wire connected to the endward terminal 5 has loosened, the columnar projection 11 also prevents the lead wire from contacting the central terminal 5.

The frames provided with the same lead wire guiding columnar projections and terminals can be arranged also on the upper flange 2.

FIGS. 8 to 12 show a second embodiment of the present invention. In these drawings, frames 4A each comprise a base part 15 of a width narrowed in response to the width dimension of apertures the pot core in which the bobbin is to be fitted and a wide part 16 are formed respectively on opposite sides of the lower flange 3. Three terminals 5A, 5B and 5C made by bending narrow metal plates are provided on the wide part 16 of each of the frames 4A. Here, the frame 4A has a step difference surface 6A lower than the inner surface of the lower flange 3 over the base part 15 and wide part 16. A columnar projection 10 for guiding lead wires is formed in the central position of the narrowed base part 15. The height of the columnar projection is set to coincide with or be lower than the level of the inner surface 17 of the lower flange 3 so as not to interfere with the winding operation. An entangler-prohibiting projection 31 is formed on the base part of each of the above mentioned terminals 5A and 5C to limit the entangling position of the lead wire. That is to say, as each of the terminals 5A and 5C on both sides of the central terminal 5B has the entangler-prohibiting projection 31 consisting of wide part of the terminal, the lead wires will bend along the columnar projection 10 and will be entangled on the narrow parts W near the tips of the terminals 5A and 5C as shown by the broken lines S and T in FIG. 9. The lead wire to the central terminal 5B may be passed on either side of the columnar projection 10.

Figure 8:
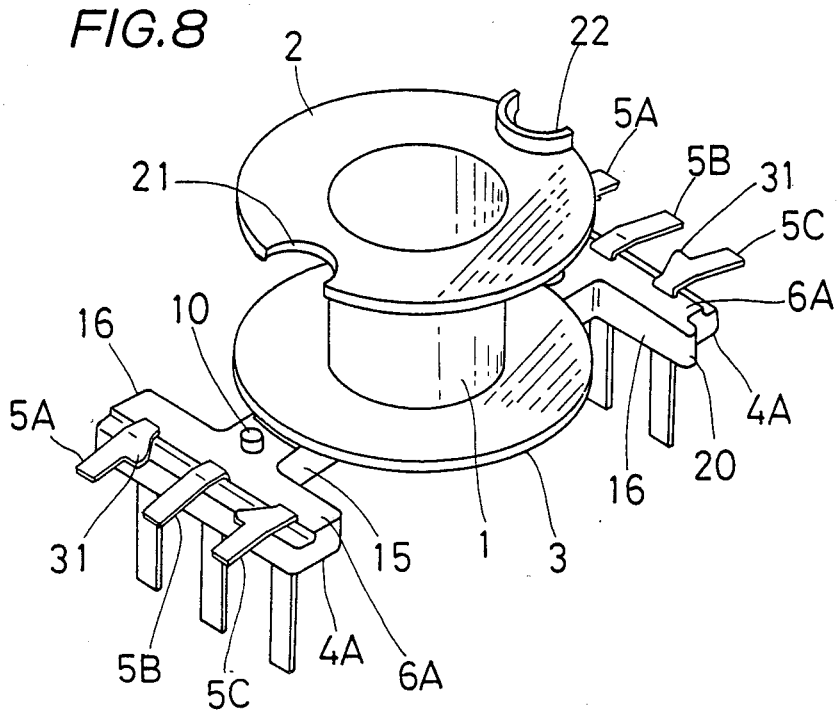
FIG. 8 is a perspective view showing a second embodiment of the present invention.
Figure 9:
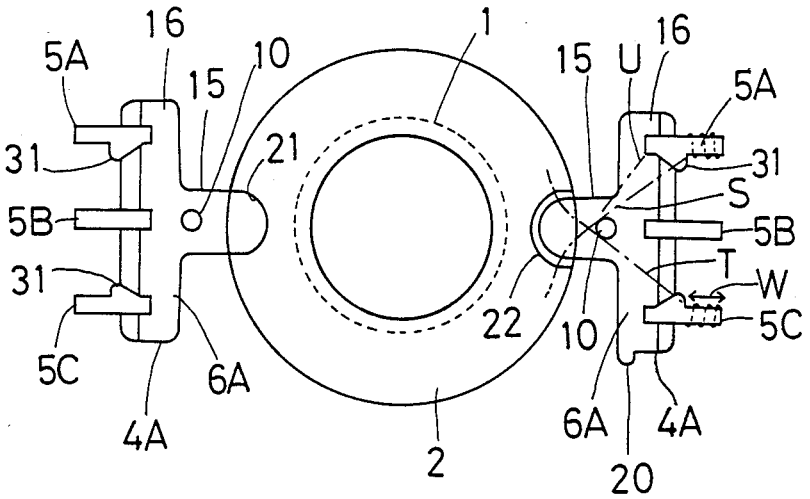
FIG. 9 is a plan view of the bobbin of FIG. 8.
Figure 10:
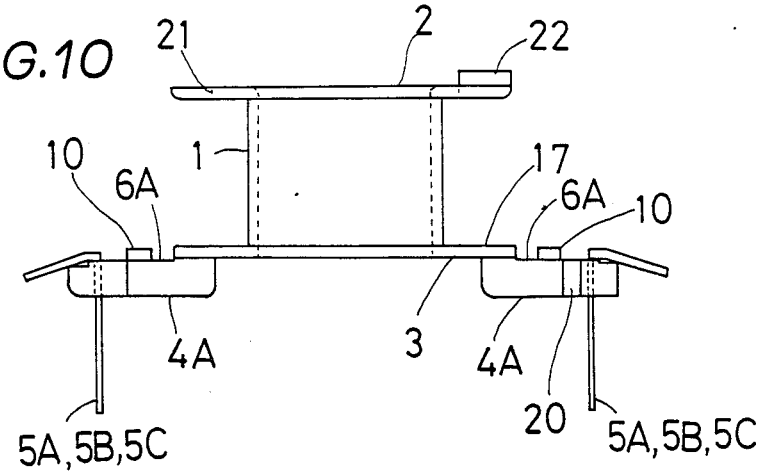
FIG. 10 is an elevational view of the bobbin of FIG. 8.
Figure 11:
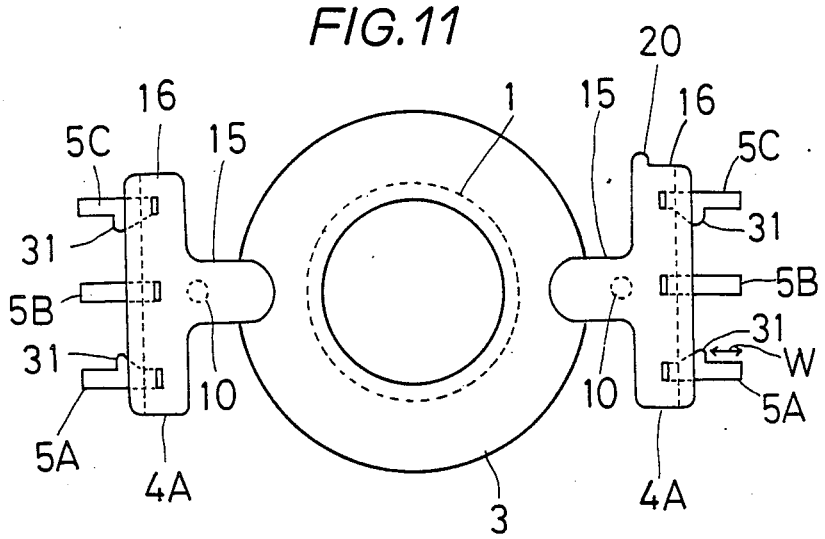
FIG. 11 is a bottom view of the bobbin of FIG. 8.
Figure 12:
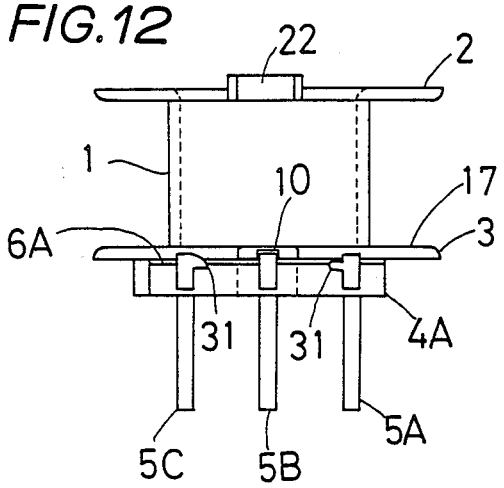
FIG. 12 is a side view of the bobbin of FIG. 8.

The structures of the cylindrical bobbin body 1 and the upper flange 2 may be the same as in the first embodiment. If cutout 21 and a rib 22 along another cutout are formed integrally with the upper flange 2 as shown in FIGS. 8 and 9, the terminal fitted bobbin will be easy to mount on to a coil winder. When the terminal fitted bobbin is fitted in the pot core, the rib 22 will prevent backlash.

A projection 20 for identification the first terminal is formed at the end of the right side frame 4A in FIG. 9.

In the connecting the lead wires (i.e. extremities of windings) to the endward terminals 5A and 5C, as shown by the broken lines S and T in FIG. 9, the lead wires may be led out as slightly bent along the columnar projection 10 and may be entangled on the narrow parts W beyond the entangler-prohibiting projections 31 formed on the terminals 5A and 5C. Thus, it is easy to process the lead wires so as not to contact the pot core fitted with the terminal fitted bobbin. Winding on the bobbin body part 1 by an automatic winder and entangling the lead wires on the terminals 5A, 5B and 5C are possible. In case there is no entangler-prohibiting projection 31, as shown by the broken line U in FIG. 9, the lead wire will likely be entangled on the base part of the terminal 5A. In such case, the lead wire will likely contact the pot core. The likelihood will be be positively eliminated by the entangler-prhbiting projection 31.

Figure 13:
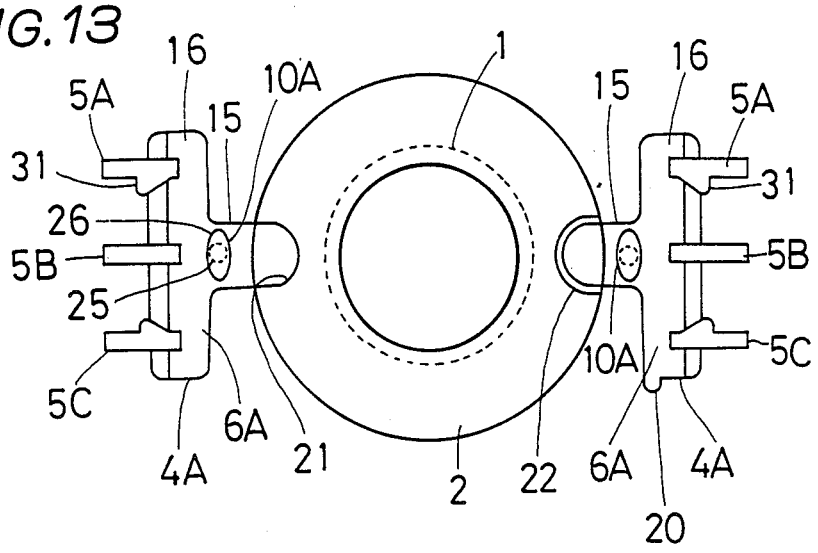
FIG. 13 is a plan view showing a third embodiment of the present invention.
Figure 14:
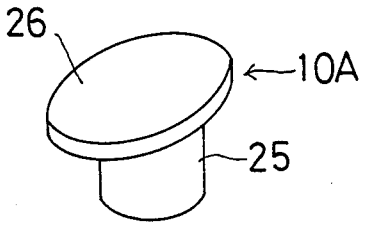
FIG. 14 is a perspective view showing a projection for guiding lead wires in the third embodiment.

FIG. 13 shows the third embodiment of the present invention. In this drawing, a lead wire guiding projection 10A for guiding lead wires is formed on a step difference surface 6A in the central position in the width direction of a narrowed base part 15. The projection 10A consists of a columnar base part 25 and an elliptic flat head part 26 larger than the base part as in FIG. 14. The height of the projection 10A is set to coincide with or be lower than the level of the inner surface of the lower flange. The other elements are the same as in the above described second embodiment. The same reference numerals are used to refer to the same parts.

In this third embodiment, the lead wire guiding projection 10A having the head part 26 larger than the section of the columnar base part 25 is formed centrally on the base part 15 of the frame 4A. Projection 10A has an advantage that the lead wires to be led out are unlikely to disengage from the projection 10A.

Figures 15A, 15B, 15C:
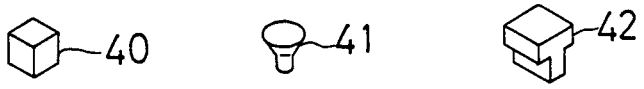
FIG. 15 is a perspective view showing modifications of lead wire guiding projections.

In the above mentioned respective embodiment, columnar projections 10, 10A and 11 have been shown but, instead of them, there may be utilized a square-sectioned pillar-like projection 40 in FIG. 15(A), a columnar projection 41 of a base part having small diameter in FIG. 15(B) or a square-sectioned pillar-like projection 42 that is thin in the base part in FIG. 15(C). In FIGS. 15(B) and 15(C), there is merit in that the lead wire is not likely to become disengaged.

Figure 16:
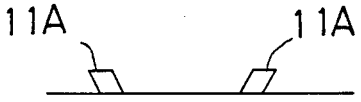
FIG. 16 is an elevational view showing modifications of the first embodiment of the present invention.

Further, as in FIG. 16, instead of the columnar projection 11 in the first embodiment, inclined columnar projections 11A inclined outward may be adopted so that the lead wire is unlikely to become disengaged.

As explained above, according to the terminal fitted bobbin of the present invention, as at least one projection for guiding lead wires is formed in a predetermined position on a frame integral with a flange, it is easy to handle lead wires at the ends of windings and it is possible to automate winding onto the bobbin body part and the processing of lead wires.

What is claimed is:

1. A bobbin for winding a coil comprising a cylindrical bobbin body, first and second opposed flanges extending transversly from said body, said first and second flanges respectively having first sides facing each other and second sides opposing the respective first sides, at least one frame extending from the second side of and generally parallel to said first flange, said frame including a plurality of electrical terminals, a first projection disposed between said terminals and said first flange and generally extending toward said second flange for directing lead wires from coils wound around said body to at least some of said electrical terminals.

2. The bobbin of claim 1 wherein said frame has a relatively narrow base portion proximate said first flange and wider distal portion remote from said first flange, said distal portion including said electrical terminals.

3. The bobbin of claim 2 wherein said projection is disposed on said base portion.

4. The bobbin of claim 2 including second and third projections generally parallel to the first projection extending from said distal portion proximate said electrical terminals.

5. The bobbin of claim 1 wherein said first and second sides are generally planar and parallel to each other and said frame includes a generally planar frame surface from which said projection extends, said frame surface being generally coplanar with the second side of said first flange.

6. The bobbin of claim 5 wherein said projection extends from said frame surface to a height not extending through the plane of said first side of said first flange.

7. The bobbin of claim 1 wherein said projection includes a stem extending from said frame and a head opposite said frame and wherein said head has a larger cross-sectional area than said stem.

8. The bobbin of claim 1 wherein at least one of said electrical terminals includes a projection proximate said frame for inhibiting entanglement of a wire wound around said terminal.

9. The bobbin of claim 1 including two of said frames extending from the second side of and generally parallel to said first flange, said frames being disposed opposite each other.

10. The bobbin of claim 1 including second and third projections generally parallel to said first projection extending from said frame proximate said electrical terminals.

11. The bobbin of claim 1 wherein said first and second sides are generally planar and parallel to each other and wherein said projection extends toward said second flange to a height not extending through the plane of said first side of said first flange.

* * * * *